US009241605B2

(12) United States Patent
Druecker et al.

(10) Patent No.: US 9,241,605 B2
(45) Date of Patent: Jan. 26, 2016

(54) WATER-USING HOUSEHOLD APPLIANCE HAVING A STORAGE CONTAINER

(75) Inventors: Markus Druecker, Guetersloh (DE); Ralph Steinmeier, Herford (DE); Dirk Wegener, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 1017 days.

(21) Appl. No.: 13/396,750

(22) Filed: Feb. 15, 2012

(65) Prior Publication Data

US 2012/0204912 A1 Aug. 16, 2012

(30) Foreign Application Priority Data

Feb. 16, 2011 (DE) ..... 10 2011 000 762

(51) Int. Cl.

| | |
|---|---|
| ***A47L 15/00*** | (2006.01) |
| ***A47L 15/42*** | (2006.01) |
| *A47L 15/48* | (2006.01) |

(52) U.S. Cl.

CPC ..... *A47L 15/4229* (2013.01); *A47L 15/4202* (2013.01); *A47L 15/4291* (2013.01); *A47L 15/0026* (2013.01); *A47L 15/0028* (2013.01); *A47L 15/0034* (2013.01); *A47L 15/483* (2013.01); *A47L 2301/08* (2013.01); *A47L 2401/06* (2013.01); *A47L 2401/09* (2013.01); *A47L 2401/34* (2013.01); *A47L 2501/05* (2013.01); *A47L 2501/34* (2013.01)

(58) Field of Classification Search

CPC ..... A47L 15/0026

See application file for complete search history.

(56) References Cited

U.S. PATENT DOCUMENTS

| | | | |
|---|---|---|---|
| 2006/0283482 | A1 | 12/2006 | Berends et al. |
| 2010/0043250 | A1 | 2/2010 | Berends et al. |

FOREIGN PATENT DOCUMENTS

| | | | |
|---|---|---|---|
| DE | 3522901 | A1 | 1/1987 |
| DE | 3930835 | A1 | 3/1991 |
| DE | 19758061 | A1 | 7/1999 |
| DE | 102007008950 | A1 | 8/2008 |
| DE | 102007056918 | B3 | 4/2009 |
| EP | 0461722 | A1 | 12/1991 |
| EP | 1080681 | A2 | 3/2001 |
| EP | 1733675 | A2 | 12/2006 |
| GB | 2139084 | A | 11/1984 |
| GB | 2210256 | | 6/1989 |

OTHER PUBLICATIONS

Stickel et al., DE3522901, Jan. 1987, English machine translation.*

European Patent Office, Extended European Search Report in European Patent Application No. 12 40 10 21.6 (Oct. 26, 2012).

* cited by examiner

*Primary Examiner* — Jason Ko

(74) *Attorney, Agent, or Firm* — Leydig, Voit & Mayer, Ltd.

(57) ABSTRACT

A water-using household appliance includes a treatment chamber, a water softener for wash or rinse water, a regenerating device associated with the water softener and configured to contain a supply of brine, and a storage container disposed in a thermally conductive relationship with the treatment chamber. The storage container includes a liquor volume, a regeneration volume for producing the brine supply, and a first outlet operable for substantially emptying the storage container.

10 Claims, 3 Drawing Sheets

WATER-USING HOUSEHOLD APPLIANCE HAVING A STORAGE CONTAINER

CROSS REFERENCE TO RELATED APPLICATIONS

This application claims priority to German Patent Application No. DE 10 2011 000 762.8, filed Feb. 16, 2011, which is hereby incorporated by reference herein.

FIELD

The present invention relates to a water-using household appliance, in particular a dishwasher, including a treatment chamber, a water softener for wash or rinse water, which is associated with a regenerating device containing a supply of brine, and further including a storage container positioned in thermally conductive relationship with the treatment chamber and containing at least a liquor volume.

BACKGROUND

German Patent DE 197 58 061 C2 describes a dishwasher which has a storage container positioned in thermally conductive relationship with a treatment chamber. Such a container may be filled with cold liquid (fresh water or softened water) so as to promote the condensation of warm moist air on the adjacent wall of the treatment chamber during a drying step of a cycle of operations. This, on the one hand, shortens the drying time and, on the other hand, makes it possible to save energy if the water from the container is used during a portion of the cycle in which heated liquid is needed. When two cycles are carried out in quick succession, the water in the second cycle contains the thermal energy it stored during the drying step of the first cycle. If there is a longer time interval between two cycles, the water is at room temperature, which is generally higher than the temperature of water which comes directly from the water supply line. In addition to promoting the condensation, the water can also store thermal energy toward the end of water-using operating cycle portions.

In water-using household appliances, it is known, and in dishwashers even common practice, to use water softeners to allow a number of water-using operating cycle portions to be performed with softened wash or rinse water. In these water softeners, an ion exchange resin exchanges the hardness-causing Ca2+ and Mg2+ ions with an equivalent amount of Na+ ions. When the ion exchange resin of the water softener is exhausted, it needs to be regenerated with brine. To this end, a supply of brine is used, which is produced in a regenerating device from salt and water, and is passed through the ion exchange resin. In order to obtain a desired brine concentration, a defined amount of water; i.e., a regeneration volume, is passed through a container filled with salt. The regeneration volume is added either as a metered quantity from a separate container, or in a volume-controlled manner via a water flow measuring device, for example, via an impeller flowmeter.

EP 1 080 681 A2 describes a switchover valve for controlling the hardness of rinse water. EP 1 733 675 A2 describes an appliance having an automatic door opening system. DE 10 2007 008 950 A1 describes the use of a fan to supply air to a countertop.

SUMMARY

In an embodiment, the present invention provides a water-using household appliance including a treatment chamber, a water softener for wash or rinse water, a regenerating device associated with the water softener and configured to contain a supply of brine, and a storage container disposed in a thermally conductive relationship with the treatment chamber. The storage container includes a liquor volume, a regeneration volume for producing the brine supply, and a first outlet operable for substantially emptying the storage container.

BRIEF DESCRIPTION OF THE DRAWINGS

Various exemplary embodiments of the present invention are shown in the drawings in a purely schematic way and will be described in more detail below.

DETAILED DESCRIPTION

Figure 1:
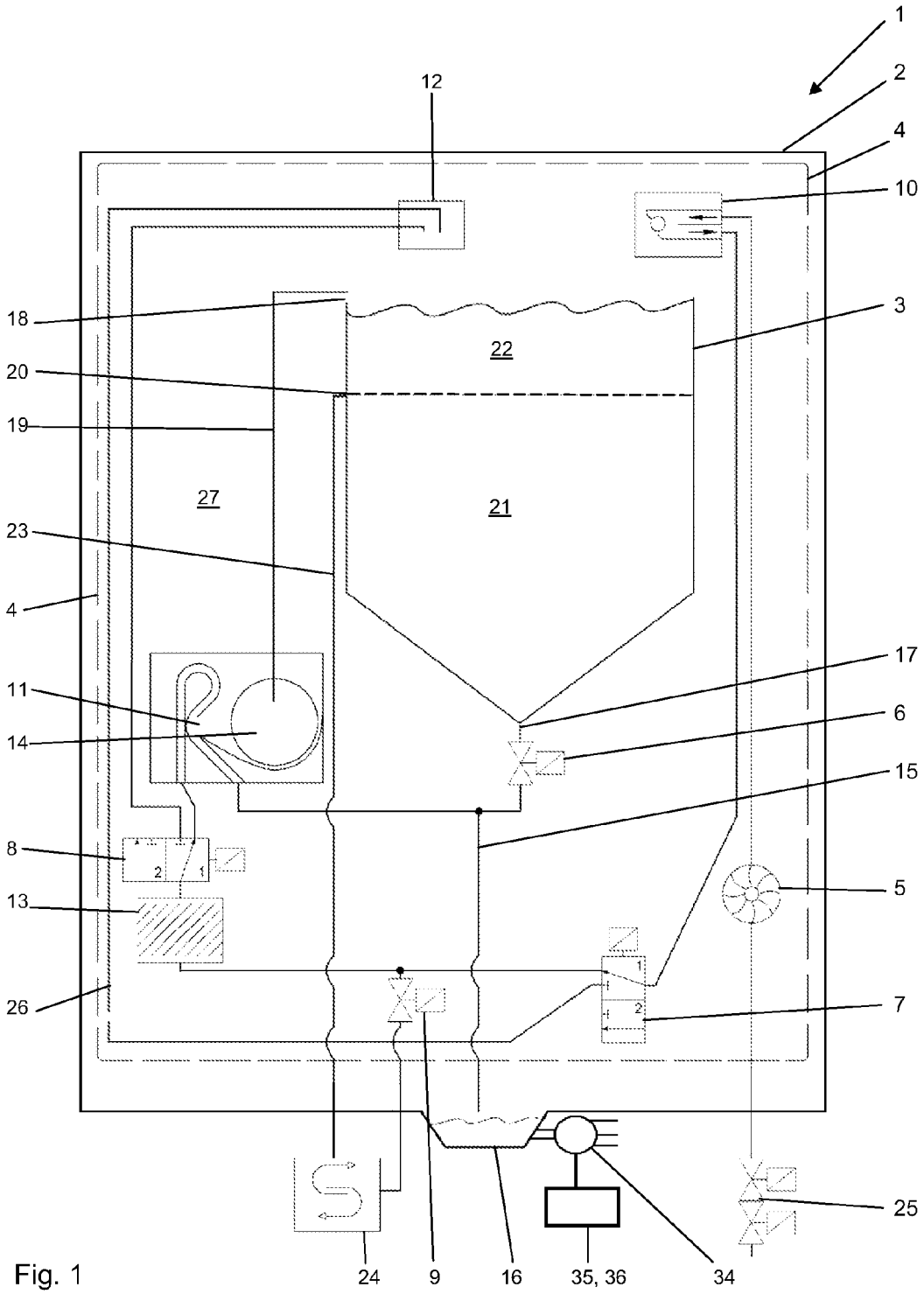
In FIGS. 1 through 3, different exemplary embodiments of a household appliance designed according to the present invention are illustrated using the example of a dishwasher. The components that are important for the water circuit of the dishwasher are depicted in schematic diagrams in manner of a flow diagram.

In an embodiment, an aspect of the present invention is to further improve the functionality of the storage container in a water-using household appliance of the type mentioned at the outset.

Since the storage container, in addition to the liquor volume, further contains a regeneration volume, which is used for producing the brine supply, the fill volume of the container is increased. Thus, a greater amount of cold water is available for cooling a wall of the treatment chamber. This also saves the cost of a separate container for holding the regeneration volume. It is advantageous if the liquor volume includes at least a portion of the amount of liquid needed in a water-using operating cycle portion. After the water has assisted in the condensation process, it can be used for further purposes. The thermal energy absorbed by the stored water is used for the next dishwashing process.

In accordance with an embodiment of the present invention, the storage container has a first outlet through which it can be emptied completely, or at least nearly so. Thus, the entire water stored in the storage container, including both the liquor volume and the regeneration volume, can flow out through the first outlet and, in particular, be fed to the washing tub, for example.

To allow the storage container to be emptied through the first outlet, a valve may be provided downstream of the outlet. Alternatively, if it is desired to dispense with this valve, the first outlet may be constituted by a siphon.

In an embodiment, the storage container has a second outlet in addition to the first outlet, said second outlet allowing only the regeneration volume to be discharged therethrough. In this manner, the amount of water needed to make the brine can be precisely metered without additional measuring devices being required. Such a method is much more accurate than measuring the amount of water entering the salt container by means of an impeller flowmeter. Nevertheless, the storage container can be emptied completely, or at least nearly so, through the first outlet as described hereinbefore.

The storage container may be filled with either softened water or fresh water. Both variants have different advantages, which will be apparent from the description of the respective exemplary embodiments.

Moreover, the storage container may have a level sensor associated therewith. The level sensor provides additional reliability in the event that a normally used water flow sensor fails to operate properly.

In an embodiment of a dishwasher, a circulation pump provided for circulating rinse water is operated at an increasing speed as the storage container is being emptied. Since the emptying of the storage container takes longer than when fresh water is introduced directly into the treatment chamber, the cycle time would be expected to increase. This can be avoided if as soon as the storage container is being emptied, the circulation pump starts to run at a low speed which adapted to the liquid level in the treatment chamber and is subsequently increased. In a first variant, the speed may be increased in a level-controlled manner. To this end, advantageously, a pump is used whose drive speed can be controlled in closed loop. In this case, the level in the collection sump can be determined from the control deviation of the drive, and the speed can be adaptively increased. In a simple variant, which is suitable for a pump drive whose speed can be controlled in open loop, the speed is increased in a time-controlled manner. Suitable ON-times and (linear or non-linear) increases in speed can be determined in tests.

It is also advantageous if the first outlet has a strainer disposed upstream thereof. This prevents the formation of lime deposits in the valves.

In an embodiment, the present invention enables the regeneration volume to be used both for regeneration purposes and for water inflow purposes while promoting, in the best possible way, the drying process and the storage and reuse of thermal energy.

Dishwasher 1, as shown in FIG. 1, has a treatment chamber in the form of a wash chamber 2, which is symbolized by a box. A storage container 3 is disposed adjacent thereto in a generally known manner. Storage container 3 is in thermally conductive contact with wash chamber 2. It forms part of a water matrix 4 symbolized by a dashed-line box. Also integrated in water matrix 4 are an impeller flowmeter 5, four valves, namely a storage outlet valve 6, a switchover valve 7 for controlling the hardness of the rinse water, a further switchover valve 8 and a regeneration valve 9, as well as three water protection devices 10 through 12 and a resin container 13 of a water softener. Water matrix 4 is fluidically connected to wash chamber 2 via second water protection device 11 and storage container 3. Water protection devices are constituted by flow gaps, which sometimes have to comply with regulations, such as those of the German Technical and Scientific Association for Gas and Water (DVGW), and are intended to prevent backflow of rinse water into the household water supply. The connection via second water protection device 11 opens into a wash chamber vent 14 in the lower portion of a wash chamber side wall 27. The connection via storage container 3 is a hose connection 15 and opens into a collection sump 16, in which wash chamber 2 terminates at the bottom. The outlet 17 of storage container 3 via hose connection 15 is controllable by means of a storage outlet valve 6. Moreover, storage container 3 is provided with an overflow 18 which, via a conduit 19 in the form of a hose connection or channel, also opens into wash chamber vent 14. In addition to outlet 17, storage container 3 has a second outlet 20, which branches from storage container 3 at a side thereof and, thus, separates a liquor volume 21 below outlet 20 and a regeneration volume 22 above outlet 20. Thus, regeneration volume 22 provides a defined amount of water and can be fed to a salt container 24 of a regenerating device via a conduit 23 in the form of a hose connection or channel. The discharge of regeneration volume 22 is controlled by means of regeneration valve 9, which is disposed downstream of salt container 24. When regeneration valve 9 is open, the brine produced in salt container 24 from salt and water flows through resin container 13, regenerates the ion exchange resin, and flows via second water protection device 11 into collection sump 16, and thus into the lower portion of wash chamber 2. To this end, second switchover valve 8 must be in position "1". Subsequently, the brine is flushed out of the resin with water. To this end, water inlet valve 25 is open and both switchover valves 7 and 8 are in position "1".

The inflow of water to wash chamber 2 and to storage container 3 is accomplished with water coming from the household water supply via a water inlet valve 25. The amount of water flowing in is determined by an impeller flowmeter 5. First water protection device 10 is disposed downstream thereof. Via first switchover valve 7, the water is directed either to resin container 13 (position "1") or directly to storage container 3 (position "2"). Second switchover valve 8 directs the softened water either to collection sump 16 (in position "1", via second water protection device 11) or to storage container 3 (in position "2", via third water protection device 12).

The aforedescribed configuration of water matrix 4 allows for the following water paths:

1. filling of storage container 3 with fresh water—first switchover valve 7 in position "2", second switchover valve 8 in any position;
2. filling of storage container 3 with softened water—first switchover valve 7 in position "1", second switchover valve 8 in position "2";
3. direct filling of wash chamber 2 with softened water—both switchover valves 7 and 8 in position "1";
4. direct filling of wash chamber 2 with fresh water—first switchover valve 7 in position "2", and alternatively either overfilling of storage container 3 or storage outlet valve 6 in the open position;
5. regenerating the ion exchange resin—storage container 3 filled, storage outlet valve 6 closed, regeneration valve 9 open, switchover valve 7 in position "2", switchover valve 8 in position "1", via second water protection device 11;
6. emptying storage container 3 into wash tub 2—storage outlet valve 6 open.

To enable the wash chamber 2 to be filled with fresh water directly while bypassing storage container 3, conduit 26, which may be in the form of a hose connection or a channel, may be routed from first switchover valve 7 (position "2") to second water protection device 11 instead of to third water protection device 12. This prevents lime deposits in storage container 3. In this case, however, it is not possible to carry out variant 1 (filling of storage container 3 with fresh water). Usually, a certain amount of fresh water is added to the softened water for glass protection purposes (very soft water dissolves calcium ions from the glass, making it dull). This blending can be achieved by combining variants 1 and 2 or 3 and 4, respectively.

The following describes a process sequence in which storage container 3 is filled and the stored water is subsequently used:

At the beginning of a drying step in a first cycle of operations, storage container 3 is filled with cold water (softened water, fresh water, or preferably soft blended water) up to overflow 18, so that it serves as a heat sink for the adjacent wash chamber side wall 27 to promote the drying process. Since the use of water enables an adequate drying performance, it is in this case possible to dispense with a fan drying system and save the energy that would be required to drive the fan. However, in appliances having an automatic door opening system, a fan may still be needed to warm and/or supply air to the countertop.

When in the next cycle of operations, the wash step is performed, the water is then discharged from storage container 3 into collection sump 16. If storage container 3 holds only a portion of the total amount of water needed, the rest is introduced directly via the water supply line. Thus, instead of cold water from the water line (15° C. according to the relevant standards), at least a partial amount of water is available that is at least at room temperature (23° C. according to the relevant standards). The increases the mixture temperature of the inflowing water and reduces the time and energy required to raise the temperature to a certain level.

In the wash step, emptied container 3 is filled up to overflow 18 toward the end of a holding time, a time during which the rinse water is at the desired temperature, and the water warms up due to the contact surface of storage container 3 with wash chamber side wall 27 The temperature level in wash chamber 2 is thereby decreased by a very small amount. In the intermediate rinse step that follows, the water is then discharged from storage container 3 and, possibly, replenished with cold water. The mixture temperature of the rinse water increases Immediately after that, storage container 3 is filled up to overflow 18 again, and the water warms up because the temperature level in wash chamber 2 is still higher. At the beginning of the final rinse step that follows, storage container 3 is emptied again and cold water is replenished. Thus, less time and energy are required for the subsequent heating of the rinse liquid to the desired temperature. The last filling of storage container 3 is the earlier mentioned filling that is carried out in the drying step.

In the case of short intermediate rinse steps (about <10 min), the emptying and filling of storage container 3 in the intermediate rinse step may alternatively be omitted because the contact time, and thus the heat transfer, would not be sufficient. The stored water from the wash step will then flow in only at the beginning of the final rinse step.

The regeneration of the ion exchange resin is carried out when the resin is exhausted. Exhaustion can be detected by a sensor in resin container 13, or be calculated from the hardness level set by the user and the total amount of water measured by impeller flowmeter 5. Then, from the amount of water that was filled in in the drying step, regeneration volume 22 is discharged via the second outlet from storage container 3 and introduced into salt container 24. The further regeneration procedure is described above. After regeneration volume 22 is discharged, it may be replenished to further promote drying.

Figure 2:
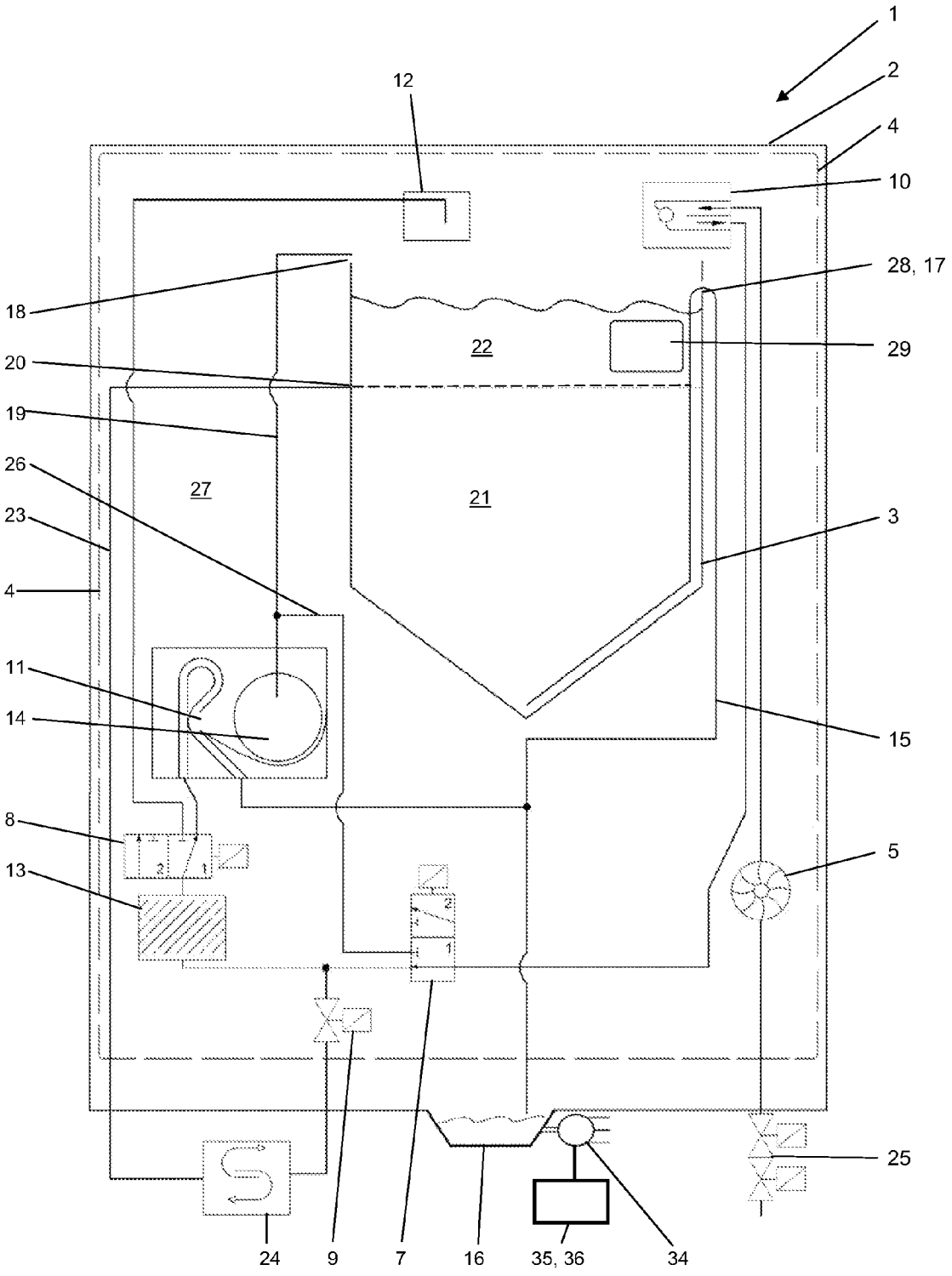

FIG. 2 shows an embodiment of a water matrix 4 where storage outlet valve 6 is dispensed with. Instead, storage container 3 is equipped with a siphon 28 as the first outlet 17. As an additional component, a level sensor 29 is required to determine when storage container 3 has been completely filled up to and including the maximum regeneration volume 22. If storage container 3 is then filled beyond the regeneration volume 22, the siphon causes complete emptying of storage container 3 into collection sump 16. Here, overflow 18 must be located above the operating level of siphon 28. The overflow merely acts as a safety feature in the event that siphon 28 is clogged. Another difference from the embodiment of FIG. 1 is that here conduit 26 is routed from first switchover valve 7 (position "2") to second water protection device 11 instead of to third water protection device 12, as has been described earlier. This allows wash chamber 2 to be filled directly with fresh water.

Figure 3:
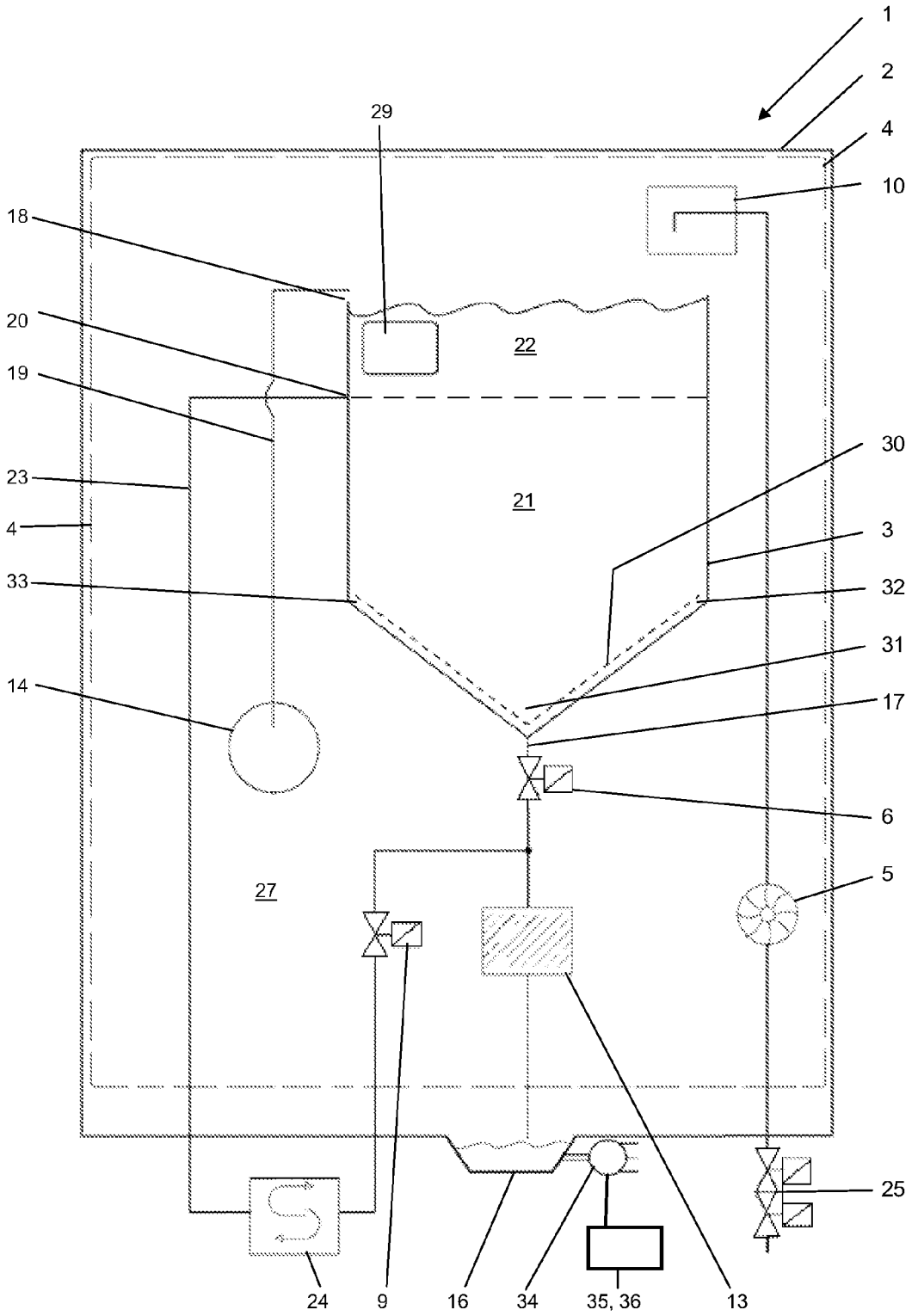

In the case of the water matrix 4 shown in FIG. 3, storage container 3 can only be filled with fresh, unsoftened water from the household water supply. Moreover, it is only possible to introduce water into wash chamber 2 that was previously in storage container 3. Thus, the two switchover valves 7 and 8 and third water protection device 12 are dispensed with. Second water protection device 11 can also be dispensed with. Here, the water from overflow 18 can be conducted directly into the wash chamber vent opening 14. As in the embodiment of FIG. 2, level sensor 29 is provided as an additional component to determine when storage container 3 has been completely filled up to and including the maximum regeneration volume 22. Moreover, storage container 3 is provided in the bottom region with a strainer 30 above the first outlet. Since storage container 3 is filled with fresh water, which is not softened and, therefore, contains lime, lime may precipitate when the water is heated and/or stored for long periods of time. In order to prevent the lime from clogging the downstream storage outlet valve 6 and a strainer in resin container 13, it is proposed to use a large-surface strainer 30 in storage container 3 for pre-filtering purposes. Advantageously, this strainer 30 is shaped in the form of a V, as a result of which a so-called "lime-retaining pocket" 31 is formed which is capable of collecting the precipitated lime over the entire life of the appliance. At the right and left sides of the upstream end of the strainer, there are provided so-called "bypass channels" 32 and 33, which allow outflow from storage container 3 even when strainer 30 is completely clogged. Preferably, strainer 30 can be removed and cleaned.

The inflow of water to storage container 3 is accomplished with water coming from the household water supply via water inlet valve 25. The amount of water flowing in is determined by an impeller flowmeter 5. First water protection device 10 is disposed downstream thereof. Overflow 18 is provided in the top region. When the maximum fill level is exceeded, water flows over through the overflow and, via wash chamber vent 14, into wash chamber 2. In order to introduce softened water into collection sump 16 of wash chamber 2, storage outlet valve 6 is opened, allowing gravity to cause the water to flow through resin container 13 and into collection sump 16. In order to empty storage container 13, storage outlet valve 6 is opened, and the content of the container (liquor volume 21 plus regeneration volume 22) flows in softened form into the collection sump. Thus, by replenishing and emptying the storage container, it can be achieved that all of the water introduced is softened water. If fresh water is to be added for glass protection purposes, storage container 3 first has to be filled and then overfilled. Then, fresh water flows through overflow 18 and wash chamber vent 14 into wash chamber 2.

In order to regenerate the ion exchange resin in resin container 13, the regeneration volume is tapped from the filled storage container 3 by opening regeneration valve 9 and caused by gravity to flow through salt container 24 and then as brine through resin container 13, from where it is directed into collection sump 16. The subsequent flushing of resin container 13 is accomplished by opening water inlet valve 25 while storage outlet valve 6 is open, so that the flow is through impeller flowmeter 5, first water protection device 10 and storage container 3.

The aforedescribed configuration of water matrix 4 allows for the following water paths:

1. filling of storage container 3 with fresh water—water inlet valve 25 open;
2. filling of storage container 3 with softened water—not possible;
3. filling of wash chamber 2 with softened water—water inlet valve 25 open, storage outlet valve 6 open;
4. direct filling of wash chamber 2 with fresh water—water inlet valve 25 open, overfilling of storage container 3;
5. regenerating the ion exchange resin—storage container 3 filled, regeneration valve 9 open, storage outlet valve 6 closed;

6. emptying storage container 3 into wash tub 2—storage outlet valve 6 open.

The process sequence in which storage container 3 is filled and the stored water is subsequently used, takes place analogously to the concept described in connection with FIG. 1.

Since in this concept, the entire inflow of softened water is via storage container 3, the time required for this process is significantly longer compared to a water inflow process during which wash chamber 2 is at least partially filled with water at line pressure, such as described in FIG. 1. Factors which influence the inflow time include, in addition to lack of pressure, resistances of conduits, valves and of the water softener, and also the decreasing static head of the water level in container 3. Therefore, the water level should remain as long as possible at a high level, so as to compensate at least for the last-mentioned influencing factor to the extent possible. To this end, storage container 3 is equipped with level sensor 29. For example, if the water inflow is to be effected with a total amount of 4 liters (storage container 3 is already filled with a partial amount of 2.5 liters from the last cycle step), then, initially, storage outlet valve 6 is opened for a period of time during which only a fraction of the content of the storage container is discharged into collection sump 16, said fraction expediently being about 0.75 liters. The valve opening time required for this can be determined in tests and stored in the appliance control system. Subsequently, storage container 3 is filled again until level sensor 29 trips. Impeller flowmeter 5 determines the amount of water replenished. If this amount is different from the desired 0.75 liter, the appliance control system can correct the valve opening time for the next partial emptying operation. The partial emptying and replenishment described above is continued until the desired total amount of water inflow minus the total volume of the storage container has been introduced. Subsequently, storage outlet valve 6 is opened until storage container 3 is completely emptied.

In a household appliance in which liquid is circulated by a circulation pump 34, the effect of slow water inflow on the cycle duration can be further reduced by turning on the pump already before storage container 3 is completely emptied. However, circulation pump 34 should be prevented from drawing in air and creating slurping noises when the liquid level in collection sump 16 is low. To this end, a pump 34 is required whose speed can be controlled in open or closed loop. Then, preferably after a partial amount of water has been introduced, this pump can start the circulation operation at a low speed and subsequently increase the speed linearly or in steps. The required rate of rise of the speed can be adjusted to the rate of outflow from storage container 3 in advanced by means of tests. This procedure is advantageous for pumps whose speed can be controlled in open loop. A corresponding speed profile can then be stored in a control device 35, which is preferably integrated in an appliance control system. In a second variant, the speed may be increased in a level-controlled manner. To this end, advantageously, a pump 34 is used whose drive speed can be controlled in closed loop. In this case, the liquid level in collection sump 16 can be determined from the control deviation of the drive, and the speed can be adaptively increased according to the liquid level. The control device 36 required for this can also be integrated in the appliance control system. Using one of the aforedescribed measures, the circulation and heating of the rinse water can already be started during the inflow of water. In the variants according to FIGS. 1 and 2, too, the circulation pump can also be turned on before storage container 3 is completely emptied, as described herein before.

LIST OF REFERENCE NUMERALS

1. dishwasher
2. wash chamber
3. storage container
4. water matrix
5. impeller flowmeter
6. storage outlet valve
7. EGS valve
8. water inlet valve 2
9. regeneration valve
10. water protection device 1
11. water protection device 2
12. water protection device 3
13. resin container
14. wash chamber vent
15. hose connection from storage container to collection sump
16. collection sump
17. first outlet of the storage container
18. overflow
19. hose connection from overflow to wash chamber vent
20. second outlet of storage container (regeneration volume)
21. liquor volume
22. regeneration volume
23. hose connection from second outlet to salt container
24. salt container
25. water inlet valve
26. hose connection from first switchover valve to water protection device 3
27. wash chamber side wall
28. siphon
29. level sensor
30. strainer
31. lime-retaining pocket
32. bypass channel
33. bypass channel
34. circulation pump
35. open-loop control device
36. closed-loop control device

What is claimed is:

1. A water-using household appliance comprising:

a treatment chamber;

a water softener for at least one of wash water and rinse water;

a regenerating device associated with the water softener and configured to contain a supply of brine; and a storage container disposed in a thermally conductive relationship with the treatment chamber, the storage container including a liquor volume, a regeneration volume for producing the brine supply, a first outlet operable for substantially emptying the storage container, and a second outlet disposed at a side of the storage container operable for discharging only the regeneration volume therethrough to the regenerating device, wherein the regeneration volume is above the second outlet and the liquor volume is below the second outlet.

2. The water-using household appliance recited in claim 1, wherein the appliance is a dish washer.

3. The water-using household appliance recited in claim 1, wherein the liquor volume includes at least a portion of an amount of liquid used in a water-using operation cycle portion.

4. The water-using household appliance recited in claim 1, further comprising a valve disposed downstream of the first outlet.

5. The water-using household appliance recited in claim 1, wherein the first outlet includes a siphon.

6. The water-using household appliance recited in claim 1, wherein the storage container is configured to be filled with soft water having passed through the water softener.

7. The water-using household appliance recited in claim 1, further comprising a water supply connection configured to supply the storage container with fresh water.

8. The water-using household appliance recited in claim 1, wherein a level sensor is associated with the storage container.

9. The water-using household appliance recited in claim 1, further comprising a circulation pump configured to circulate rinse water and configured to operate at an increasing speed as the storage container is emptying.

10. The water-using household appliance recited in claim 1, wherein a strainer is disposed upstream of the first outlet.

* * * * *